US010982846B2

(12) United States Patent
Beard et al.

(10) Patent No.: US 10,982,846 B2
(45) Date of Patent: Apr. 20, 2021

(54) VORTEX RECIRCULATING COMBUSTION BURNER HEAD

(71) Applicant: Webster Combustion Technology LLC, Winfield, KS (US)

(72) Inventors: Justin J. Beard, Arkansas City, KS (US); Edward Corbett, Cedar Vale, KS (US); Joachim Philip Sondervan, Winfield, KS (US); Joseph Brandon Vanderpool, Arkansas City, KS (US)

(73) Assignee: Webster Combustion Technology LLC, Winfield, KS (US)

( * ) Notice: Subject to any disclaimer, the term of this patent is extended or adjusted under 35 U.S.C. 154(b) by 136 days.

(21) Appl. No.: 15/622,270

(22) Filed: Jun. 14, 2017

(65) Prior Publication Data

US 2018/0363898 A1 Dec. 20, 2018

(51) Int. Cl.

| | |
|---|---|
| ***F23M 9/00*** | (2006.01) |
| ***F23D 14/24*** | (2006.01) |
| ***F23D 14/70*** | (2006.01) |

(52) U.S. Cl.

CPC ..... *F23D 14/24* (2013.01); *F23D 14/70* (2013.01)

(58) Field of Classification Search

CPC ..... F23C 7/004; F23C 9/006; F23D 14/24; F23D 1/00; F23D 14/22; F23D 14/02;

(Continued)

(56) References Cited

U.S. PATENT DOCUMENTS 3,741,166 A * 6/1973 Bailey ..... F23C 9/00 122/23
4,443,182 A * 4/1984 Wojcieson ..... F23C 7/00 239/406

(Continued)

FOREIGN PATENT DOCUMENTS

JP S5240032 3/1977
JP S58117911 7/1983

(Continued)

OTHER PUBLICATIONS

International Search Report and the Written Opinion of the International Searching Authority, International Application No. PCT/US2018/037328, pp. 1-8, dated Aug. 31, 2018.

(Continued)

*Primary Examiner* — Jason Lau
(74) *Attorney, Agent, or Firm* — Bond, Schoeneck & King, PLLC

(57) ABSTRACT

A vortex recirculating combustion head for a burner, including: a housing having a through-bore, an upstream end, and a downstream end, the upstream and downstream ends arranged at opposite sides of the through-bore, the housing configured to receive combustion air; a primary fuel inlet arranged adjacent to the upstream end of the housing configured to introduce a primary fuel stream into the housing; a secondary fuel inlet arranged downstream of the primary fuel inlet configured to introduce a secondary fuel stream into the housing; a flame retention head including a diffuser plate secured to the downstream end of the housing, the diffuser plate including a plurality of openings, a plurality of fins, and a ring; and, an extension member secured to an exterior surface of the flame retention head.

16 Claims, 3 Drawing Sheets

(58) Field of Classification Search
CPC .. F23D 14/58; F23D 2201/10; F23D 2201/20; F23D 11/406; F23D 14/32; F23D 14/62; F23D 23/00; F23D 2900/14701; F23D 2900/21002; F23D 11/402; F23D 14/08; F23D 14/14; F23D 14/16; F23D 14/48; F23D 14/66; F23D 14/70; F23D 14/82; F23D 1/005; F23D 1/04; F23D 2206/10; F23D 2208/00; F23D 2209/20; F23D 2900/05002; F23D 2900/14241; F23D 3/40; F23D 5/123; F23D 11/10; F23D 11/105; F23D 11/40; F23D 11/441; F23D 14/045; F23D 14/06; F23D 14/10; F23D 14/105; F23D 14/60; F23D 14/64; F23D 14/68; F23D 14/84; F23D 17/007; F23D 2201/101; F23D 2204/00; F23D 2209/10; F23D 2900/00014; F23D 2900/00016; F23D 2900/11401; F23D 2900/14002; F23D 2900/14021; F23D 2900/14481; F23D 5/04; F23D 99/00; F23R 3/286; F23R 3/20; F23R 2900/00002; F23R 3/06; F23R 3/343; F23R 3/36; F23R 3/16; F23R 3/18; F23R 3/28; F23R 3/32; F23R 3/34; F23R 3/44; F23R 2900/00004; F23R 2900/00013; F23R 2900/00014; F23R 2900/00015; F23R 2900/03341; F23R 2900/03343; F23R 3/005; F23R 3/26; F23R 3/283; F23R 3/30; F23R 3/346; F23R 3/42; F23R 3/46; F23R 3/56; F23R 3/14
See application file for complete search history.

(56) References Cited

U.S. PATENT DOCUMENTS

| | | | | |
|---|---|---|---|---|
| 5,195,884 | A | 3/1993 | Schwartz et al. | |
| 5,415,539 | A | 5/1995 | Musil | |
| 6,474,250 | B1 * | 11/2002 | Penterson | F23D 1/02 110/261 |
| 2004/0197719 | A1 | 10/2004 | Chung et al. | |
| 2005/0158682 | A1 | 7/2005 | Morris | |
| 2005/0175945 | A1 * | 8/2005 | Chung | F23C 6/047 431/116 |
| 2008/0166671 | A1 | 7/2008 | Jones | |
| 2016/0076763 | A1 | 3/2016 | Bätz et al. | |
| 2017/0198902 | A1 | 7/2017 | Zink et al. | |
| 2017/0299190 | A1 | 10/2017 | Patel et al. | |

FOREIGN PATENT DOCUMENTS

| | | |
|---|---|---|
| JP | H06213416 | 8/1994 |
| JP | H09089212 | 4/1997 |
| JP | H09133315 | 5/1997 |
| JP | 2004191032 | 7/2004 |
| JP | 2005283029 | 10/2005 |
| JP | 2008138901 | 6/2008 |

OTHER PUBLICATIONS

International Preliminary Report on Patentability, International Application No. PCT/US2018/037328, pp. 1-7, dated Dec. 17, 2019.
Notification of Reasons for Rejection, Japanese Patent Application No. 2019-566645, pp. 1-5, dated Dec. 2, 2020.
Examination Report, Indian Patent Application No. 201917048872, pp. 1-7, dated Feb. 5, 2021.

* cited by examiner

VORTEX RECIRCULATING COMBUSTION BURNER HEAD

FIELD OF THE INVENTION

The present disclosure relates generally to a combustion burner head, and more specifically, to a vortex recirculating combustion burner head that generates low concentrations of carbon monoxide and nitrogen oxide emissions.

BACKGROUND

A common problem associated with burning fossil fuels is the generation and emission of carbon monoxide and nitrogen oxides ($NO_x$). In gas and oil fired boilers, fuel and air are mixed in a burner and an ignition device is provided to ignite the mixture in a combustion chamber. Heat is generated within the combustion chamber and transferred by a heat exchanger. Flue gases are released from a stack of the heat exchanger and can be recirculated into the combustion process to reduce emissions of nitrogen oxides. Such a process is known as flue gas recirculation (FGR). Flue gas recirculation (FUR) lowers the temperature of the flame and therefore reduces the amount of thermal $NO_x$ emissions. Flue gas recirculation (FGR) also plays a role in minimizing carbon monoxide (CO) levels.

Other processes, such as, fuel lean pre-mixing of the oxidant and fuel, air staging, and fuel staging are also used to reduce emissions of nitrogen oxides. Fuel staging involves burning a small amount of a primary fuel stream as an ignition source for a secondary fuel stream. Fuel staging reduces the temperature in the main chamber thereby reducing the amount of thermal nitrogen oxide emissions.

Current regulations require single-digit $NO_x$ levels, for example, sub-9 parts per million (ppm) and sub-5 ppm. Unfortunately, as $NO_x$ levels decrease, flame stability also decreases. Flame location and attachment are important when addressing flame stability. For example, it is desirable to locate the flame as close as possible to the burner to maximize the effective boiler area. Additionally, it is desirable for the flame to move as little as possible while modulating to achieve maximum performance. While others have attempted to reduce the amount of harmful CO and $NO_x$ emissions in combustion burners, improvements are needed for further reducing the amount of carbon monoxide and nitrogen oxides generated and emitted while maintaining flame stability.

SUMMARY OF THE INVENTION

The present disclosure is directed to an inventive combustion head for operating a combustion burner such that reduced concentrations of carbon monoxide and nitrogen oxide are emitted and flame stability is maintained. The combustion head includes a diffuser plate with a plurality of fins to provide a vortex and uniform spin. The combustion head also includes a ring secured to an exterior surface of the diffuser to help stabilize the vortex. The system can also include flue gas recirculation.

An advantage of an embodiment of the combustion head for a burner is that the flame stabilizes between the nose of the burner and the wall of a boiler. In an embodiment of the combustion head, the flame is anchored to the front of the burner. Another advantage of an embodiment of the combustion head is that the flame base is on the combustion chamber.

The vortex recirculating combustion burner described herein can be made of any suitable materials, including ceramics, polymers, ferrous and non-ferrous metals and their alloys and composites.

Generally, in one aspect, there is provided a vortex recirculating combustion head for a burner, including: a housing having a through-bore, an upstream end, and a downstream end, the upstream and downstream ends arranged at opposite sides of the through-bore, the housing configured to receive combustion air; a primary fuel inlet arranged adjacent to the upstream end of the housing configured to introduce a primary fuel stream into the housing; a secondary fuel inlet arranged downstream of the primary fuel inlet configured to introduce a secondary fuel stream into the housing; a flame retention head including a diffuser plate secured to the downstream end of the housing, the diffuser plate including a plurality of openings, a plurality of fins, and a ring; and an extension member secured to an exterior surface of the flame retention head According to an embodiment, the plurality of fins are equally spaced circumferentially.

According to an embodiment, the extension member is arranged at a downstream end of the flame retention head.

According to an embodiment, at least one tangential orifice secured within one of the plurality of openings is included, the at least one tangential orifice configured to redirect a portion of the primary fuel stream away from the ring.

According to an embodiment, each of the plurality of fins includes a first end and a second end where the first end is free and the second end is adjacent to the ring.

According to an embodiment, the second end abuts the ring.

According to an embodiment, each of the plurality of fins is arranged at an angle relative to a vertical axis of the combustion head where the angle is between 5-50 degrees.

According to an embodiment, each of the plurality of fins is arranged at an angle relative to a vertical axis of the combustion head where the angle is between 20-40 degrees.

According to an embodiment, each of the plurality of fins is arranged at an angle relative to a vertical axis of the combustion head where the angle is approximately 30 degrees.

According to an embodiment, a plurality of tangential orifices are included and secured within the plurality of openings, each tangential orifice including a hollow body and a head having an opening where the hollow body and the opening are connected such that fuel can pass therethrough and where the opening is arranged approximately 90 degrees relative to the hollow body.

Generally, in another aspect, a vortex recirculating combustion head for a burner is provided including: a housing having a through-bore, an upstream end, and a downstream end, the upstream and downstream ends arranged at opposite sides of the through-bore, the housing configured to receive combustion air; a primary fuel inlet arranged adjacent to the upstream end of the housing configured to introduce a primary fuel stream into the housing; a secondary fuel inlet arranged downstream of the primary fuel inlet configured to introduce a secondary fuel stream into the housing; a flame retention head including a diffuser plate secured to the downstream end of the housing, the diffuser plate including a plurality of openings, a plurality of fins, and a ring; and an extension member secured to an exterior surface of the flame retention head. The plurality of openings are arranged radially outward of the ring and the plurality of fins are arranged radially inward of the ring.

According to an embodiment, the extension member is arranged at a downstream end of the flame retention head.

According to an embodiment, at least one tangential orifice is included and secured within one of the plurality of openings, the at least one tangential orifice configured to redirect a portion of the primary fuel stream away from the ring.

According to an embodiment, each of the plurality of fins is arranged at an angle relative to a vertical axis of the combustion head where the angle is between 5-50 degrees.

According to an embodiment, a plurality of tangential orifices is included and secured within the plurality of openings, each tangential orifice including a hollow body and a head having an opening where the hollow body and the opening are connected such that fuel can pass therethrough and where the opening is arranged approximately 90 degrees relative to the hollow body.

Generally, in a further aspect, a vortex recirculating combustion head for a burner is provided including: a housing having a through-bore, an upstream end, and a downstream end, the upstream and downstream ends arranged at opposite sides of the through-bore, the housing configured to receive combustion air; a primary fuel inlet arranged adjacent to the upstream end of the housing configured to introduce a primary fuel stream into the housing; a secondary fuel inlet arranged downstream of the primary fuel inlet configured to introduce a secondary fuel stream into the housing; a flame retention head including a diffuser plate secured to the downstream end of the housing, the diffuser plate including a plurality of openings, a plurality of fins, and a ring; and, an extension member secured to an exterior surface of the flame retention head. A flame is stabilized radially outward of the flame retention head in operation.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from the embodiments described below.

BRIEF DESCRIPTION OF THE DRAWINGS

The foregoing will be apparent from the following more particular description of example embodiments of the present disclosure, as illustrated in the accompanying drawings in which like reference characters refer to the same parts throughout the different views. The drawings are not necessarily to scale, emphasis instead being placed upon illustrating embodiments of the present disclosure.

DETAILED DESCRIPTION OF EMBODIMENTS

Figure 1:
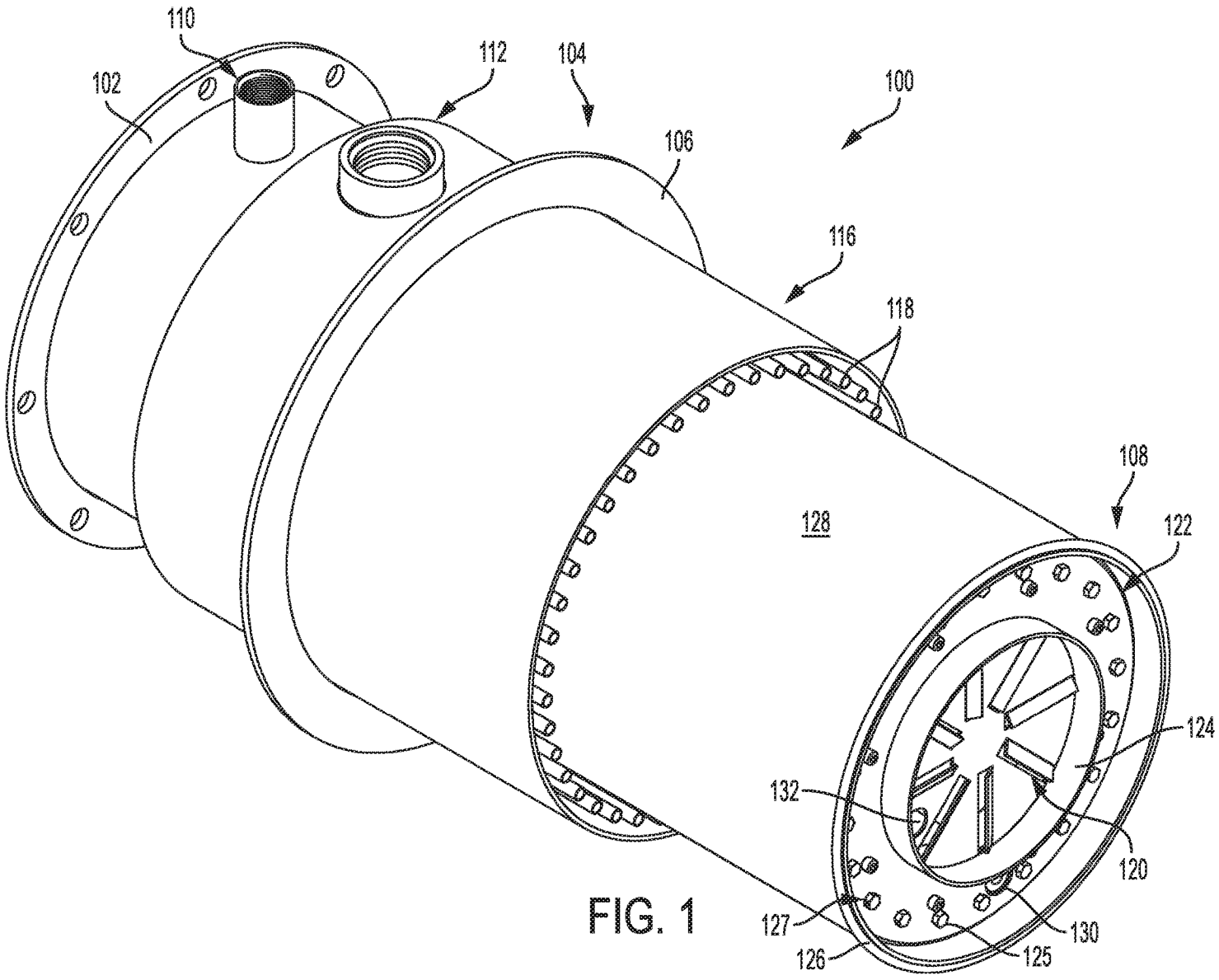
FIG. 1 is a perspective view of a vortex recirculating combustion head for a burner, in accordance with an example embodiment of the present disclosure.

A description of example embodiments of the invention follows.

Referring now to the drawings, wherein like reference numerals refer to like parts throughout, there is shown a vortex recirculating combustion head 100 for a burner that generates low concentrations of carbon monoxide and nitrogen oxide emissions while simultaneously providing improved flame stability. While the figures illustrate a vortex recirculating combustion head including primary and secondary fuel inlets which are arranged in an upward facing orientation, it should be appreciated that, in operation, the vortex recirculating combustion head is arranged such that the primary and secondary fuel inlets are arranged in a downward facing orientation or any orientation.

Figure 3:
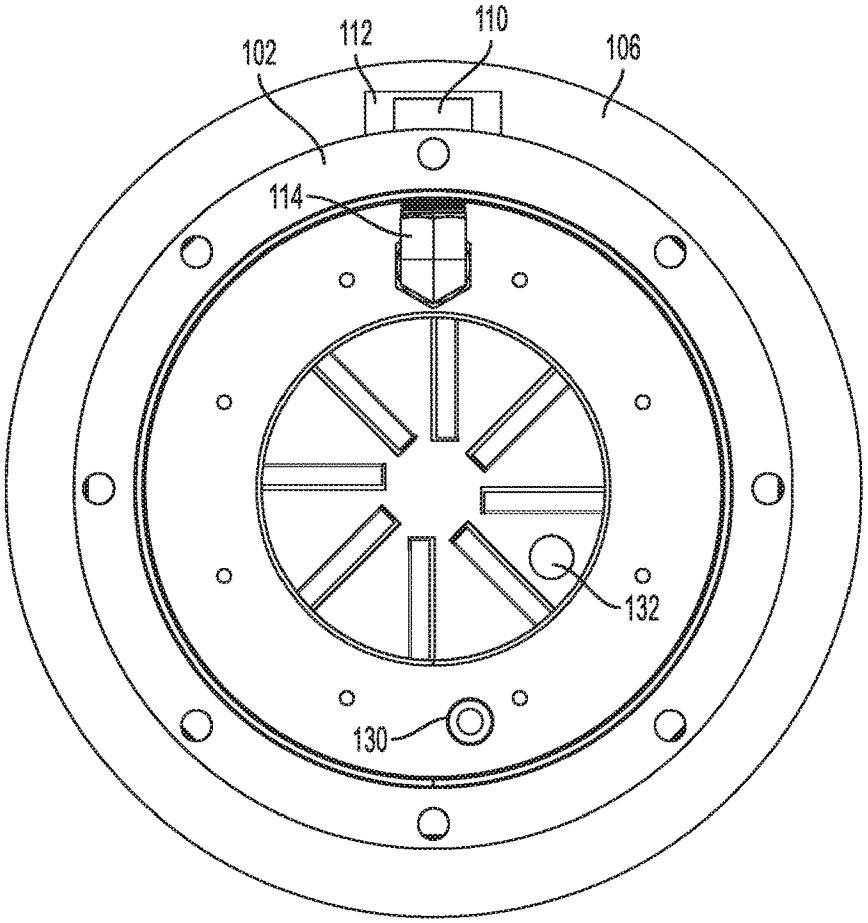
FIG. 3 is a left end elevational view of the vortex recirculating combustion head of FIG. 1, in accordance with an example embodiment of the present disclosure.
Figure 2:
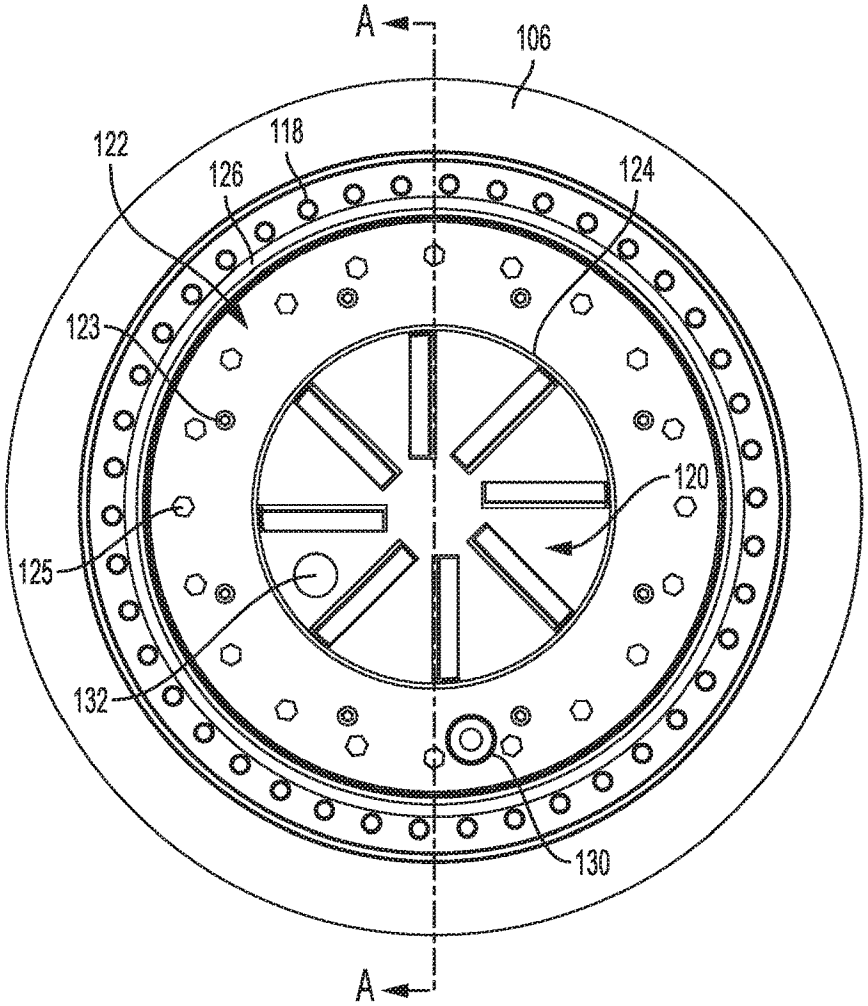
FIG. 2 is a right end elevational view of the vortex recirculating combustion head of FIG. 1, in accordance with an example embodiment of the present disclosure.
Figure 4:
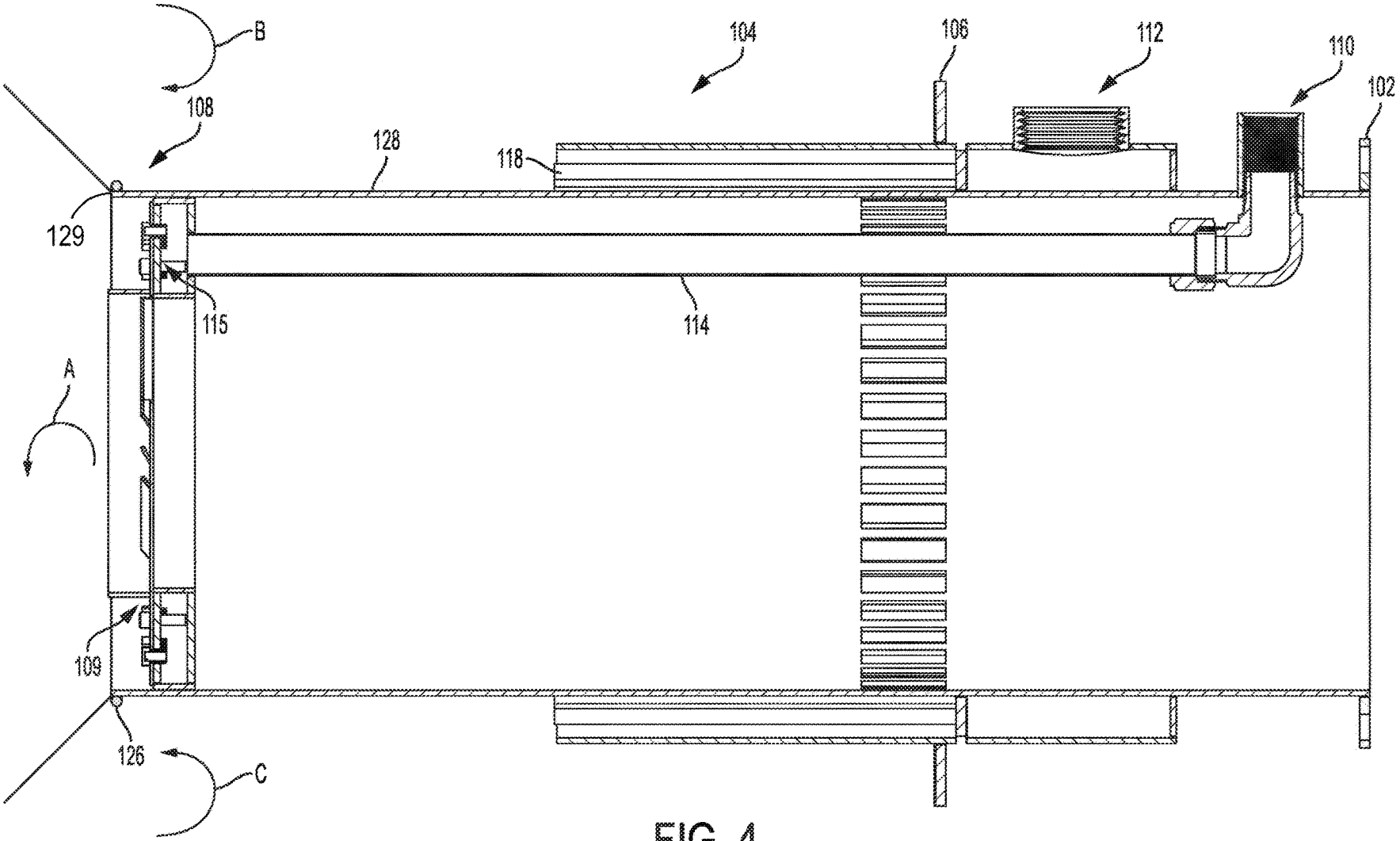
FIG. 4 is a cross-sectional view of the vortex recirculating combustion head of FIG. 1, taken generally along line A-A in FIG. 2, in accordance with an example embodiment of the present disclosure.

A perspective view of a vortex recirculating combustion head 100 for a burner is shown in FIG. 1, in accordance with an embodiment. FIG. 2 is a right end elevational view of the vortex recirculating combustion head of FIG. 1. FIG. 3 is a left end elevational view of the vortex recirculating combustion head of FIG. 1. FIG. 4 is a cross-sectional view of the vortex recirculating combustion head of FIG. 1, taken generally along line A-A in FIG. 2. The following should be viewed based on FIGS. 1-4. The vortex recirculating combustion head 100 generally includes an inlet flange 102 configured to be connected with a combustion air fan or blower with bolts via the apertures within the inlet flange, a housing 104, a mounting flange 106 configured to be connected with a combustion chamber, a flame retention head 108, and primary and secondary fuel inlets 110, 112. It should be appreciated that the location of the mounting flange 106 can be modified according to different burner/combustion chamber configurations. For example, in an embodiment, the mounting flange can be arranged further downstream from the position shown in the figures. Any suitable position may be used.

The inlet flange 102, which is arranged at an upstream end of the housing 104, is connected to a combustion air fan or blower and oxidant is supplied to the housing 104 through the combustion air fan.

A primary fuel stream is delivered to the burner at a primary inlet 110 and through fuel tube 114 through the through-bore of the housing 104, through manifold 115, and into a primary combustion zone where it mixes with the oxidant to produce a primary flame.

A secondary fuel stream is delivered to the burner at secondary inlet 112, through the through-bore of the housing 104, through the manifold 116, and into a plurality of circumferentially arranged fuel injectors 118. The fuel injectors are arranged around an external surface 128 of the housing 104 within a plenum including air. The secondary fuel stream is mixed with air to provide a secondary air and gas flow.

The flame retention head 108 is secured at a downstream end of the housing 104, which is opposite the upstream end of the housing where the inlet flange 102 is arranged. The flame retention head 108 includes a diffuser plate 109 which includes a plurality of fins 120, a plurality of openings 122, a plurality of mounting bolt openings 123 for bolts, and a ring 124. The diffuser plate 109 is arranged along a vertical axis of the combustion head. In an embodiment, the plurality of openings 122 are arranged outside radially relative to the mounting bolt openings 123, the ring 124, and the plurality of fins 120. The plurality of fins 120 are arranged inside radially relative to the ring 124 and the openings 122 and 123. In other words, the openings 122 and 123, the plurality of fins 120, and the ring 124 are concentrically arranged.

According to an embodiment, each fin of the plurality of fins 120 is arranged at an angle relative to the vertical axis of the combustion head where the angle is between 5-50 degrees. According to an embodiment, each fin of the plurality of fins 120 is arranged at an angle relative to the vertical axis where the angle is between 20-60 degrees. According to an embodiment, each fin of the plurality of fins 120 is arranged at an angle relative to the vertical axis where the angle is approximately 30 degrees. According to an embodiment, each fin of the plurality of fins 120 is substantially rectangular shaped. However, any suitable configuration and/or shape may be used instead. According to an embodiment, the plurality of fins 120 are equally spaced circumferentially. Although there are eight fins shown in the embodiment depicted in the figures, it should be appreciated that additional or fewer fins may be used instead. For example, in an example embodiment, there are four fins equally spaced circumferentially. According to an embodiment, each fin of the plurality of fins 120 includes a first end and a second end where the first end is free and the second end is adjacent to the ring 124. Each fin may be secured to and abutting the ring 124 for increased stability. The term "free" is intended to mean not connected to another physical structure. According to an embodiment, the plurality of fins 120 can be produced within the steel diffuser plate 109 by forming openings by laser cutting, plasma cutting, or any other suitable method. After the openings are formed, blades can then be fixedly secured on top of the openings by welding, for example, or any other suitable method.

According to an embodiment, an ignition source 130 is provided radially outward of the ring 124 and the plurality of fins 120. According to an embodiment, the primary and secondary fuel inlets 110, 112 are arranged approximately 180 degrees circumferentially from the ignition source 130. In an example embodiment, the hole for the scanner tube 132 is arranged approximately 90 degrees from the ignition source 130. In another example embodiment, the scanner tube 132 is arranged less than 90 degrees circumferentially from the ignition source 130. In another example embodiment, the scanner tube 132 is arranged between 90 and 180 degrees circumferentially from the ignition source 130 (in either the clockwise or counter-clockwise direction).

According to an embodiment, the hole 132 for a flame scanner tube is provided within the flame retention head 108. In an embodiment, the flame scanner tube is arranged within the hole 132 radially inward of the ring 124 and the plurality of openings 122 and proximate to the plurality of fins 120. In an embodiment, the hole and the scanner tube 132 are arranged between two adjacent fins of the plurality of fins 120. The scanner itself is not placed within the housing as the hot FGR gasses would destroy it. Instead, the scanner is arranged within a UV scanner tube (not shown) which extends from the back of the housing (not shown) through the diffuser 109 at hole 132 to fix the angle of the scanner and to make sure that the scanner is appropriately positioned. It should be appreciated that the tube can be fixed at the back of the housing at any suitable location. For example, in an embodiment, a UV scanner is arranged within the tube less than 180 degrees circumferentially from the primary and secondary fuel inlets 110, 112 (in the counter-clockwise direction as shown in FIG. 2). It should be appreciated that the hole and the scanner tube 132 can also be arranged less than 180 degrees circumferentially from the fuel inlets 110, 112 in the clockwise direction as well. In an example embodiment, the hole and the scanner tube 132 are arranged less than 90 degrees circumferentially from the fuel inlets 110, 112 in either the clockwise or counter-clockwise direction.

In FIG. 2, there are twenty openings 122 arranged radially outward of eight mounting bolt openings 123. However, additional or fewer openings and/or bolt openings can be used. In an example embodiment, the openings 122 are filled with tangential orifices 125. In an example embodiment including tangential orifices 125, one quarter, half, or three quarters of the tangential orifices can be used (or any other suitable number of tangential orifices). In an example embodiment, each tangential orifice 125 is arranged to provide gas to the pilot zone and ignite the burner. Each tangential orifice 125 includes a hollow body and a head including an opening. Surrounding the exterior of the hollow body of each tangential orifice is external threading used to secure it within an opening 122. In an example embodiment, the head is hexagonal; however any suitable shape can be used instead. In operation, the primary fuel stream passes through each tangential orifice by passing through the hollow body first and then passing through the opening in the head. Using a hexagonal head as an example, the opening in the head is arranged to extend from the hollow body center through one of the six sides of the head. Thus, the opening in the head redirects the primary fuel stream radially outwardly away from the ring 124. In an example embodiment, the opening in the head is arranged approximately 90 degrees relative to the hollow body. In FIG. 1, an example opening 127 in the hexagonal head is shown. The opening 127 in the head is much smaller than the hollow body so that the primary fuel stream is redirected in a controlled manner. For example, the tangential orifice 125 can be 0.578" long including a hollow body having a diameter of 0.203" and an opening of the head having a diameter of 0.062" where the head is 0.375" wide. Unlike conventional openings which direct the gas straight, the tangential orifices described herein redirect the gas radially, keeping the gas inside the primary zone, thus starting the ignition. A tangential orifice 125 can be made by drilling the middle out of a bolt to form the hollow body and drilling a connecting side hole in the head. In an alternate embodiment, there can be additional openings in additional sides of the head or additional openings in the same side of the head.

According to an embodiment, the flame retention head 108 includes an extension member 126 secured to the exterior surface 128 of the flame retention head 108 and adjacent an outermost circumferential edge 129. The extension member 126 is arranged at a downstream end of the flame retention head 108. In an example embodiment, the extension member 126 is a cylindrical ring of ¼" round stock. In an example embodiment, the extension member 126 is a cylindrical ring of ⅜" round stock. However, any suitable alternative shapes and sizes may be used instead. For example, a rectangular ring may be used. In an example embodiment, a rectangular ring that is ⅜" high and ½" long is provided. In another example embodiment, a rectangular ring that is ¼" high and ⅜" long is provided.

During operation, the diffuser plate 109 creates a mix rotation on the combustion air flowing therethrough and recirculation is generated downstream of the nose of the burner due to the primary air in the center (shown in FIG. 4 with arrow A). Recirculation is also generated within the combustion chamber adjacent to a base wall of the combustion chamber due to the secondary air and gas flow introduced outside the exterior surface 128 of the flame retention head 108. Such recirculation is located upstream of the nose of the burner and radially outside of the burner (shown in FIG. 4 with arrows B and C). The recirculated secondary air and gas flow is ignited by the primary flame. The diffuser plate 109 of the flame retention head 108 advantageously provides a vortex and uniform spin. The extension member 126, which is secured to the exterior surface 128 of the flame retention head 108 and adjacent an outermost circumferential edge 129 of flame retention head 108, advantageously stabilizes the vortex. As opposed to being retained on the primary zone of the burner, the flame during operation stabilizes radially outward of the nose of the burner. In an example embodiment, the flame during operation stabilizes between the nose of the burner and a wall of a combustion chamber of a boiler. During operation, a flame is produced having the flame boundary shown in FIG. 4 that starts at the outside of the flame retention head 108 and extends outwardly toward the walls of a combustion chamber.

According to an embodiment, a burner including the vortex recirculating combustion head described herein includes a heat exchanger coupled to the combustion chamber. A flue gas recirculation system can be coupled with a heat stack of the heat exchanger and configured to recirculate flue gases back into a windbox of the burner. The recirculated flue gas reduces $NO_x$ emissions by diluting the fuel/air mixture and suppressing the thermal $NO_x$ mechanism. The recirculated flue gas also lowers the oxygen concentration in the primary flame zone thereby reducing the formation of $NO_x$. In order to control the flow of combustion air into the housing 104, a damper can be arranged proximate to the windbox of the burner.

The vortex recirculating combustion burner head including FGR was tested in a 4S-350 model, a four-pass waterback scotch boiler available from Burnham Commercial located in Lancaster, Pa. The specific burner included a flat diffuser 109 with eight slots which were bent at 30 degrees relative to the vertical axis. The flat slotted diffuser 109 included a 12 Ga diffuser ring of 7.125". The slots were covered with 3" ¾" fins 120 to direct air away from moving in the forward direction. The outer diffuser ring was 1" high. The secondary gas tubes included no orifices. The front of the burner (primary) included nine #51×1 orifices and ten blanks. Eight bolts were installed in the primary zone. No washers were installed behind the diffuser, but a gasket was used instead. A ¼" rod 126 cut to 37.75" in length was rolled and welded on the tip of the primary zone to push the flame outward.

Using the above setup at low fire, a streak from the primary zone into the secondary zone is observed indicating that the complete primary and secondary zones are in contact. Thus, the flame is attached in this example embodiment. The flame boundary extends radially outward (at an angle in the downstream direction) toward the wall of the combustion chamber from the extension member 126. Moreover, the flame does not move during operation of this example embodiment. The following table includes results from tests of the above setup. As shown in the table below, at Point 7 the amount of $NO_x$ emissions is 0.0 ppm $O_2$:

| | Point 1 | Point 2 | Point 3 | Point 4 | Point 5 | Point 6 | Point 7 |
|---|---|---|---|---|---|---|---|
| Power | 4.9 | 5.4 | | | | 8.7 | 10.17 |
| Windbox $O_2$ [%] | | | | | | 17.0 | 19.5 |
| $O_2$ [%] | 3.3 | 3.5 | 3.3 | 3.0 | 4.0 | 4.1 | 7.8 |
| CO [ppm corr] | 0 | 0 | 0 | 0 | 0 | 0 | 0 |
| $NO_x$ [ppm corr] | 4.8 | 4.1 | 4.0 | 3.3 | 1.8 | 1.8 | 0.0 |

In another example test using a boiler by the former Kewanee Boiler Company (model LM888), the following example parameters were used. At Point 1 the Total Rate in MBTU/h is 3,329,802 where the following actuators are arranged at the following positions: the secondary fuel butterfly position is at 22.2 degrees, the air butterfly position is at 12.9 degrees, the primary fuel butterfly position is at 6 degrees, and the FGR butterfly position is at 9.5 degrees. Also at Point 1, the following operating pressures are used: the primary gas pressure at the head is 12.2 inches of water column (IWC), the secondary gas pressure at the head is at 0.7 IWC, the blower housing pressure is at 1.7 IWC, the boiler chamber pressure is at 0.06 IWC, and the fan inlet pressure is at −16.8 IWC. The blower housing $O_2$ percentage is at 17.3 and the blower housing temperature is 128 degrees F. In this same example embodiment at Point 1, the ambient air temperature is 66 degrees F. and the stack temperature is at 339 degrees F. With these parameters at Point 1, the amount of $O_2$ emissions is 3.7, the amount of CO emissions is 8 ppm corrected at 3% $O_2$, the amount of $NO_x$ emissions is 3.5 ppm corrected at 3% $O_2$, and the amount of $CO_2$ emissions is 9.6%.

In an example embodiment using the Kewanee LM888 boiler, when the percentage of $O_2$ in the windbox is in the range of 15-16%, the $NO_x$ emissions are in the range of 4.8-5 ppm corrected at 3% $O_2$. In the same example embodiment, when the percentage of $O_2$ in the windbox rises (in the range of 17-20%), the $NO_x$ emissions decrease to levels in the range of 2-3 ppm corrected at 3% $O_2$.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A vortex recirculating combustion head for a burner, comprising:

a housing having a through-bore, an upstream end, and a downstream end, the upstream and downstream ends arranged at opposite sides of the through-bore, the housing configured to receive combustion air;

a primary fuel inlet arranged adjacent to the upstream end of the housing configured to introduce a primary fuel stream into the housing;

a secondary fuel inlet arranged downstream of the primary fuel inlet configured to introduce a secondary fuel stream into the housing, the secondary fuel inlet in fluid communication with a plurality of fuel injectors configured to generate the secondary fuel stream outside of an exterior surface of the housing and upstream from the extension member;

a flame retention head comprising a diffuser plate secured to the downstream end of the housing, the diffuser plate comprising a plurality of openings, a plurality of fins, and a ring; and, an extension member secured adjacent an outermost circumferential edge of the flame retention head such that the secondary fuel stream deflects off of the extension member to generate a recirculation radially outside of the extension member wherein at least a portion of the recirculation is generated upstream from the extension member.

2. The vortex recirculating combustion head of claim 1, wherein the plurality of fins are equally spaced circumferentially.

3. The vortex recirculating combustion head of claim 1, wherein the extension member is arranged at a downstream end of the flame retention head.

4. The vortex recirculating combustion head of claim 1, further comprising at least one tangential orifice secured within one of the plurality of openings, the at least one tangential orifice configured to redirect a portion of the primary fuel stream away from the ring.

5. The vortex recirculating combustion head of claim 1, wherein each of the plurality of fins comprises a first end and a second end where the first end is free and the second end is adjacent to the ring.

6. The vortex recirculating combustion head of claim 5, wherein the second end abuts the ring.

7. The vortex recirculating combustion head of claim 1, wherein each of the plurality of fins is arranged at an angle relative to a vertical axis of the combustion head where the angle is between 5-50 degrees.

8. The vortex recirculating combustion head of claim 1, wherein each of the plurality of fins is arranged at an angle relative to a vertical axis of the combustion head where the angle is between 20-40 degrees.

9. The vortex recirculating combustion head of claim 1, wherein each of the plurality of fins is arranged at an angle relative to a vertical axis of the combustion head where the angle is approximately 30 degrees.

10. The vortex recirculating combustion head of claim 1, further comprising a plurality of tangential orifices secured within the plurality of openings, each tangential orifice comprising a hollow body and a head having an opening where the hollow body and the opening are connected such that fuel can pass therethrough and where the opening is arranged approximately 90 degrees relative to the hollow body.

11. A vortex recirculating combustion head for a burner, comprising:

a housing having a through-bore, an upstream end, and a downstream end, the upstream and downstream ends arranged at opposite sides of the through-bore, the housing configured to receive combustion air;

a primary fuel inlet arranged adjacent to the upstream end of the housing configured to introduce a primary fuel stream into the housing;

a secondary fuel inlet arranged downstream of the primary fuel inlet configured to introduce a secondary fuel stream into the housing, the secondary fuel inlet in fluid communication with a plurality of fuel injectors configured to generate the secondary fuel stream outside of an exterior surface of the housing and upstream from the extension member;

a flame retention head comprising a diffuser plate secured to the downstream end of the housing, the diffuser plate comprising a plurality of openings, a plurality of fins, and a ring; and, an extension member secured adjacent an outermost circumferential edge of the flame retention head such that the secondary fuel stream deflects off of the extension member to generate a recirculation radially outside of the extension member, wherein the plurality of openings are arranged radially outward of the ring and the plurality of fins are arranged radially inward of the ring and wherein at least a portion of the recirculation is generated upstream from the extension member.

12. The vortex recirculating combustion head of claim 11, wherein the extension member is arranged at a downstream end of the flame retention head.

13. The vortex recirculating combustion head of claim 11, further comprising at least one tangential orifice secured within one of the plurality of openings, the at least one tangential orifice configured to redirect a portion of the primary fuel stream away from the ring.

14. The vortex recirculating combustion head of claim 11, wherein each of the plurality of fins is arranged at an angle relative to a vertical axis of the combustion head where the angle is between 5-50 degrees.

15. The vortex recirculating combustion head of claim 11, further comprising a plurality of tangential orifices secured within the plurality of openings, each tangential orifice comprising a hollow body and a head having an opening where the hollow body and the opening are connected such that fuel can pass therethrough and where the opening is arranged approximately 90 degrees relative to the hollow body.

16. A vortex recirculating combustion head for a burner, comprising:

a housing having a through-bore, an upstream end, and a downstream end, the upstream and downstream ends arranged at opposite sides of the through-bore, the housing configured to receive combustion air;

a primary fuel inlet arranged adjacent to the upstream end of the housing configured to introduce a primary fuel stream into the housing;

a secondary fuel inlet arranged downstream of the primary fuel inlet configured to introduce a secondary fuel stream into the housing, the secondary fuel inlet in fluid communication with a plurality of fuel injectors configured to generate the secondary fuel stream outside of an exterior surface of the housing and upstream from the extension member;

a flame retention head comprising a diffuser plate secured to the downstream end of the housing, the diffuser plate comprising a plurality of openings, a plurality of fins, and a ring; and, an extension member secured about an exterior circumferential surface of the flame retention head, wherein the secondary fuel stream deflects off of the extension member to generate a recirculation radially outward and upstream of the flame retention head and a flame is stabilized by at least a portion of the recirculation in operation.

* * * * *